US005184425A

United States Patent [19]

Anderson

[11] Patent Number: 5,184,425

[45] Date of Patent: Feb. 9, 1993

[54] DRILL BIT SHARPENER

[76] Inventor: Steven P. Anderson, 6660 Reseda Blvd., Suite 112, Reseda, Calif. 91335

[21] Appl. No.: 876,587

[22] Filed: Apr. 30, 1992

Related U.S. Application Data

[63] Continuation-in-part of Ser. No. 869,637, Apr. 16, 1992.

[51] Int. Cl.[5] ..... B24B 3/24

[52] U.S. Cl. ..... 51/149; 51/211 R; 51/358

[58] Field of Search ..... 51/149, 156, 157, 211 R, 51/214, 288, 204, 358, 370, 391; 8/90, 91

[56] References Cited

U.S. PATENT DOCUMENTS

| | | | |
|---|---|---|---|
| 1,004,894 | 10/1911 | Muhl | 51/156 |
| 2,360,079 | 10/1944 | Smith | 51/211 H |
| 4,747,235 | 5/1988 | Priebe | 51/211 R |
| 4,897,965 | 2/1990 | Friel | 51/128 |

*Primary Examiner*—Bruce M. Kisliuk
*Assistant Examiner*—Jack Lavinder
*Attorney, Agent, or Firm*—Kelly Bauersfeld & Lowry

[57] ABSTRACT

A drill bit sharpener includes a molded plastic superstructure extending upwardly from a base plate. The superstructure includes a pair of diametrically opposed inclined surfaces. Each inclined superstructure surface has two parallel U-shaped channels and one V-shaped channel disposed adjacent to an outer edge of the superstructure. A diamond-coated plate is adhered to the bottom of each U-shaped channel and to the outermost interior surface of the V-shaped channel to provide grinding surfaces for sharpening the face and the backside of a cutting edge of a drill bit. Co-planar parallel smooth planar sections of the upper surfaces of the superstructure provide finger guides upon which a user, grasping a drill bit, rests his fingers during sharpening of the face of the drill bit in the U-shaped channels.

18 Claims, 2 Drawing Sheets

FIG. 1
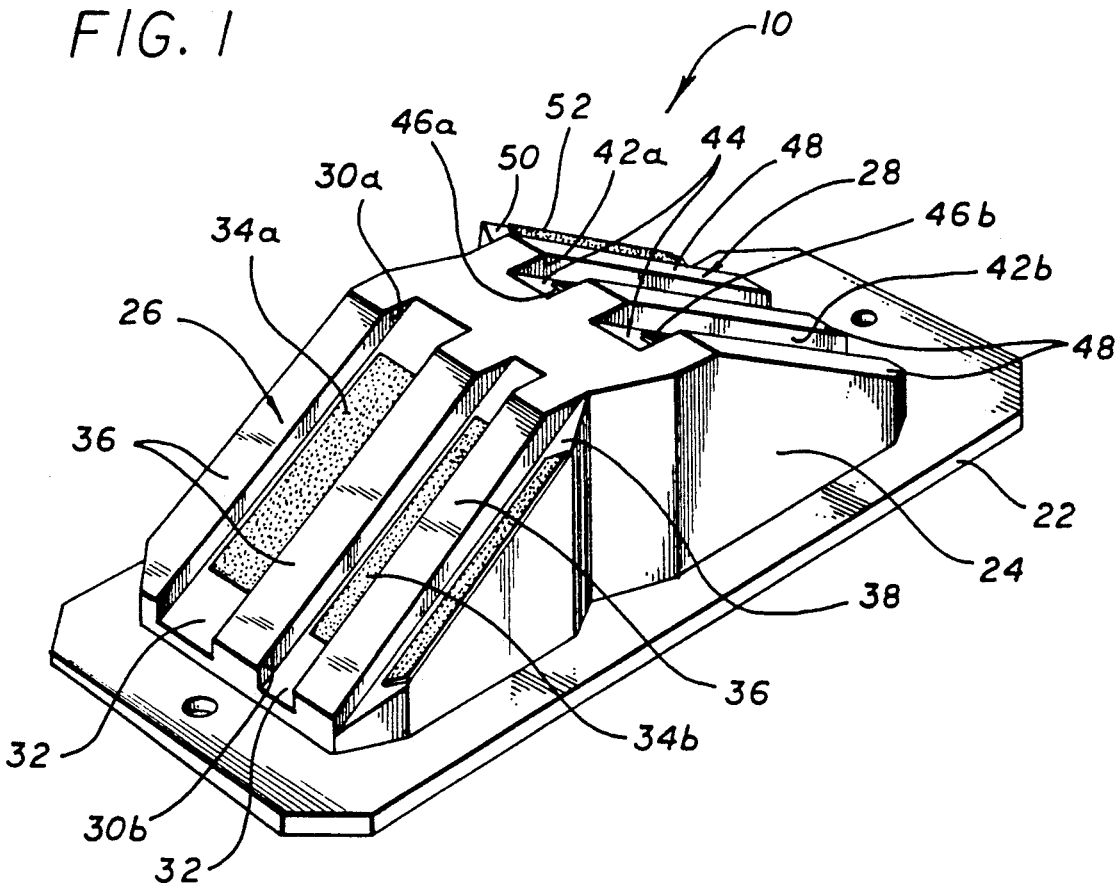
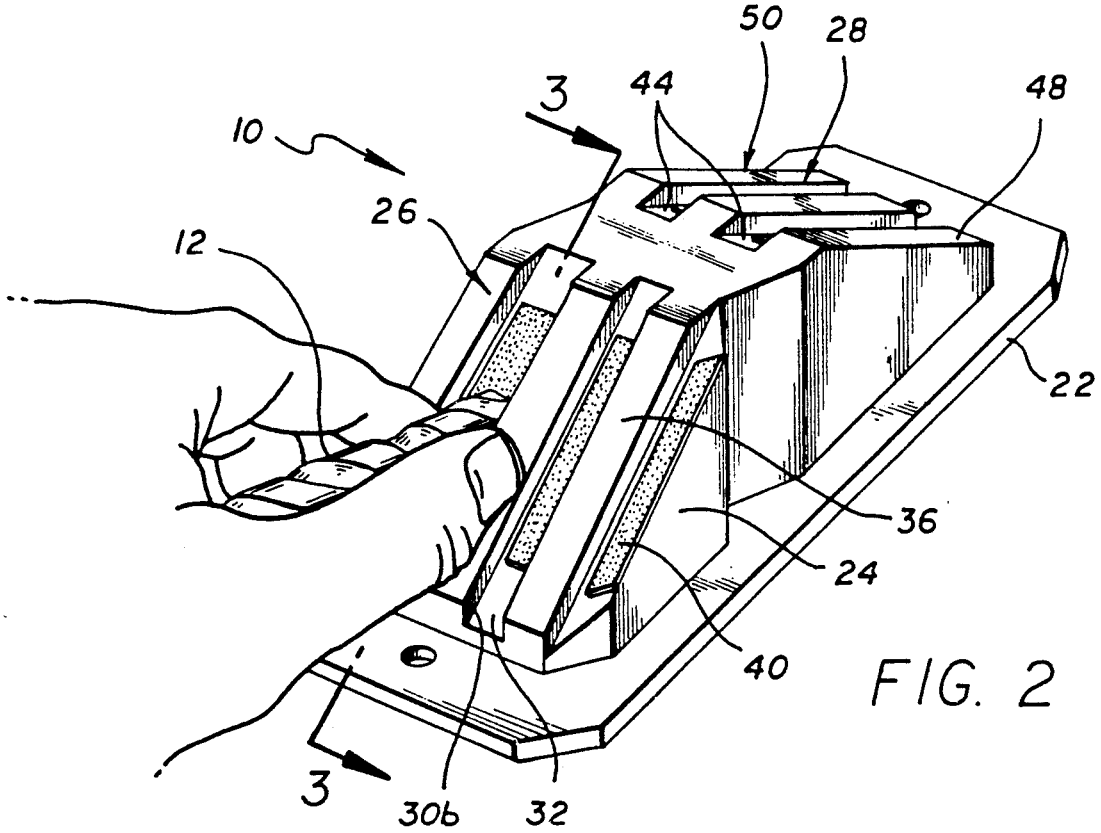
FIG. 2

FIG. 3
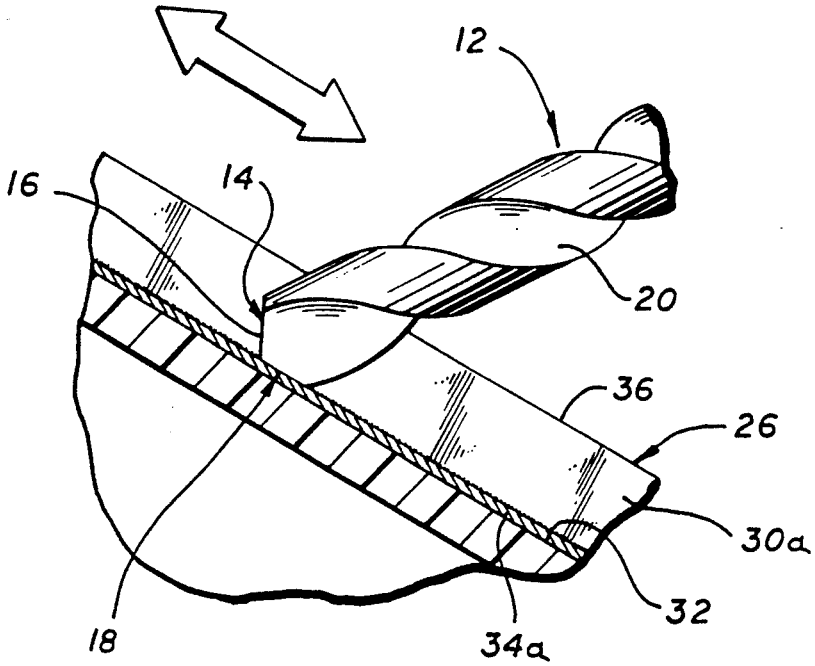
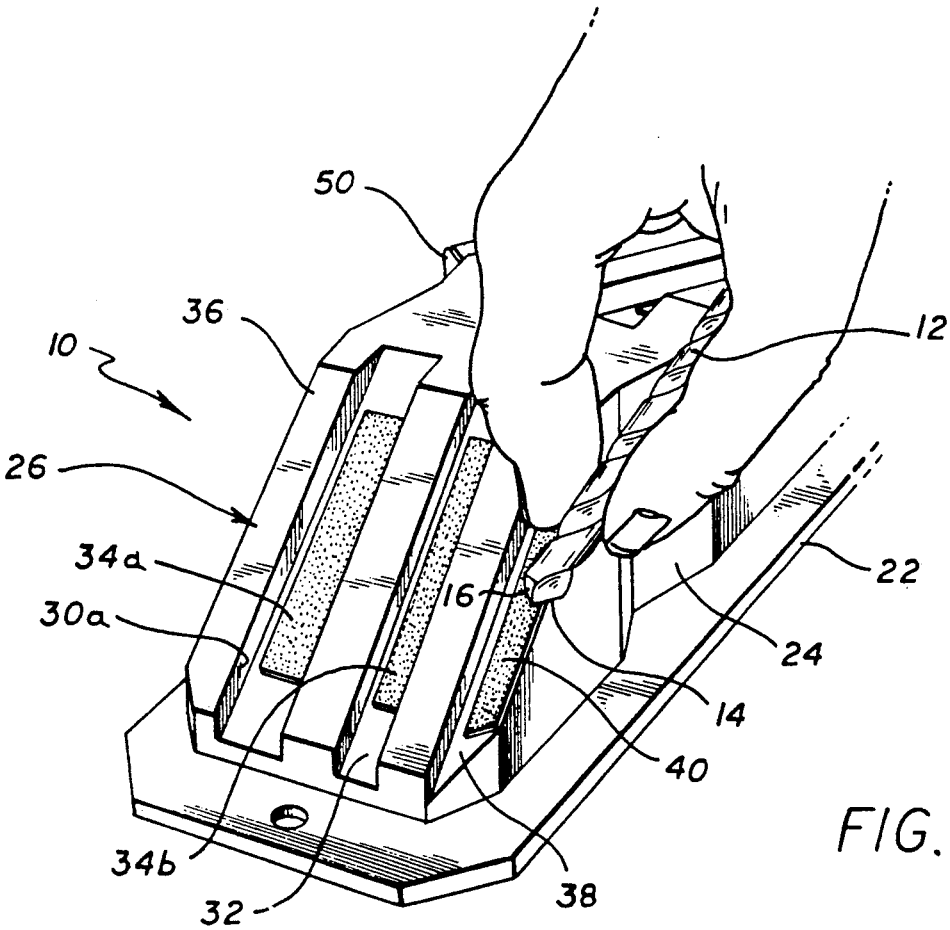
FIG. 4

DRILL BIT SHARPENER

RELATED APPLICATION

This is a continuation-in-part of U.S. patent application Ser. No. 07/869,637, filed Apr. 16, 1992 and entitled DRILL BIT SHARPENER still pending.

BACKGROUND OF THE INVENTION

This invention relates generally to devices designed to sharpen high speed drill bits. More specifically, the present invention relates to an apparatus for sharpening high speed drill bits of various sizes, which provides inclined grinding surfaces for sharpening not only the face of the drill bit but also the backside of the cutting edge.

As is well known in the art, most high speed drill bits are generally cylindrical and have a pointed leading end. The leading end comprises the drill bit face and provides the cutting edge of the bit. Typically, two helical channels extend the length of the drill bit and at the leading end define "draft" on the drill bit face. Drill bit draft is necessary to conduct cuttings away from the drill site. Without draft a bit would not cut.

Eventually, after a period of use, most drill bits will become dull and require sharpening of the cutting edge. After an extended period of use the cutting edge will actually bend or knurl over towards the backside thereof, reducing the cutting effectiveness of the bit. In order to sharpen the cutting edge of the drill bit face, a small hand-held, rectangular flat diamond sharpener has been utilized. This style of sharpener consists of a small plate-like body having a rectangular diamond-coated plate fastened onto one end. Such sharpeners are utilized in a manner similar to traditional metal files.

The prior hand held sharpener plates suffer the drawback of being sometimes difficult to handle, and have limitations in the manner of use. No provision is made to assure that there will be draft on the drill bit face after sharpening. Further, prior sharpeners provide inadequate access to the inside or backside of the drill bit cutting edge, where the knurling of the cutting edge is found.

Accordingly, there has been a need for a novel drill bit sharpener which operates in a much more advanced and sophisticated manner in comparison with the prior file-like sharpeners. Such an improved sharpener should accommodate manual sharpening of a high speed drill bit and be capable of being hand supported on a flat surface for speed and stability when sharpening bits. Additionally, such a drill bit sharpener should help to ensure that the least amount of metal is removed from the top of the drill bit face during a grinding process to retain adequate draft on the bit surface. Moreover, a novel drill bit sharpener is needed which provides access to the inside or backside of the drill bit cutting edge. The present invention fulfills these needs and provides other related advantages.

SUMMARY OF THE INVENTION

The present invention resides in an improved drill bit sharpener designed to allow for much more speed and stability when sharpening drill bits. The drill bit sharpener comprises, generally, a base plate for supporting the drill bit sharpener over planar surface, and a superstructure extending upwardly from the base plate having a first generally upwardly inclined surface. Means are fixed to the first surface, for grinding the cutting edge of a drill bit.

In a preferred form of the invention, the superstructure includes a second surface which generally inclines upwardly from the base in a manner similar to the first surface. The first and second surfaces are disposed diametrically opposite to one another and meet to define an upper end of the superstructure. The superstructure and the base plate are formed of an integral molded plastic unit.

A first pair of parallel U-shaped channels are disposed within the first surface. The U-shaped channels extend generally from the base plate to the upper end of the superstructure, and each has a diamond-coated plate adhered to a bottom surface thereof for sharpening a face of a drill bit. The first pair of parallel U-shaped channels have different widths.

A second pair of parallel U-shaped channels are similarly disposed within the second surface. The second pair of U-shaped channels extend generally from the base plate to the upper end of the superstructure, and each has a diamond-coated plate adhered to a bottom surface thereof for sharpening a face of the drill bit.

A first V-shaped channel is disposed within the first surface adjacent to an outer edge of the superstructure. The first V-shaped channel extends generally parallel to the first pair of U-shaped channels, and has a diamond-coated plate adhered to an outermost interior surface thereof to provide means for sharpening a backside of a cutting edge of the drill bit.

A second V-shaped channel is likewise disposed within the second surface adjacent to an outer edge of the superstructure. The second V-shaped channel extends generally parallel to the second pair of U-shaped channels, and has a diamond-coated plate adhered to an outermost interior surface thereof to provide means for sharpening a backside of a cutting edge of the drill bit.

Planar finger guides are disposed on each side of the first and second pairs of U-shaped channels to help a user properly position a drill bit in one of the U-shaped channels.

Sharpening a drill bit on the diamond coated plates within the U-shaped channels creates slightly more pressure on the lower side of the drill bit face. The effect is that the least amount of metal is removed from the top of the drill bit face, which is the cutting edge of the bit. The greatest amount of metal is removed at the bottom of the drill bit face. This ensures that there will be a draft on the bit surface. The V-shaped channels advantageously permit access to the inside or backside of the drill bit cutting edge.

Other features and advantages of the present invention will become apparent from the following more detailed description, taken in conjunction with the accompanying drawings which illustrate, by way of example, the principles of the invention.

DESCRIPTION OF THE DRAWINGS

The accompanying drawings illustrate the invention. In such drawings:

FIG. 1 is a front, top and left side perspective view of a drill bit sharpener embodying the present invention;

FIG. 2 is a perspective view of the drill bit sharpener similar to that illustrated in FIG. 1, showing the manner in which a drill bit is grasped and positioned within a U-shaped channel for sharpening a face of the drill bit against a diamond-coated plate at the bottom of the channel, and how planar finger guides on each side of the channel are utilized to help position the user's hand by providing sliding surfaces for the fingers;

FIG. 3 is an enlarged fragmented and partially sectional view taken generally along the line 3—3 of FIG. 2, illustrating the manner in which sharpening of one of the drill bit surfaces on a sloped angle creates slightly more pressure on the lower side of the drill bit face to maintain draft on the bit surface; and FIG. 4 is another perspective view of the drill bit sharpener illustrated in FIG. 1, showing the manner in which a V-shaped channel provided adjacent to an outer edge of the superstructure is utilized to access and sharpen a backside of the drill bit cutting edge.

DETAILED DESCRIPTION OF THE PREFERRED EMBODIMENT

As shown in the drawings for purposes of illustration, the present invention is concerned with an improved drill bit sharpener, generally designed in FIG. 1 by the reference number 10. The improved drill bit sharpener 10 is designed to sharpen high speed drill bits 12, and is ideally suited for either field use or shop use.

High speed drill bits 12 are generally cylindrical in shape and have a pointed leading end 14. The leading end 14 comprises a drill bit face 16, which provides the cutting edge 18 of the bit 12. Two helical channels 20 extend the length of the drill bit 12. Then, typically, at the end of the drill bit channels are two drill bit faces 16, each with draft and with both faces angling up to a point.

In accordance with the present invention, and as illustrated in FIGS. 1 through 4, the drill bit sharpener 10 includes a rigid planar base plate 22 for supporting the drill bit sharpener over a planar surface. A superstructure 24 extends upwardly from the base plate 22 and has a first surface 26 generally inclining upwardly from the base plate, and a second surface 28 also generally inclining upwardly from the base plate. The first and second surfaces 26 and 28 are disposed diametrically opposite to one another and meet to define an upper end of the superstructure 24. The superstructure 24 and the base plate 22, in the preferred embodiment, comprise an integral molded plastic unit.

The first surface 26 includes a first pair of parallel U-shaped channels 30*a* and 30*b* which extend from and are inclined upwardly with respect to the base plate 22. The first pair of U-shaped channels 30*a* and 30*b* are of different widths to accommodate the sharpening of drill bits 12 of various diameters. For example, the larger of the U-shaped channels 30*a* is designed to accommodate drill bits 12 up to 0.5 inch diameter. The other U-shaped channel 30*b* is designed to accommodate drill bits down to 0.03125 inch diameter. Each of the U-shaped channels 30*a* and 30*b* have a flat bottom surface 32 to which a diamond-coated plate 34*a* or 34*b* is adhered. The diamond-coated plates 34*a* and 34*b* are designed for manual grinding of the drill bit face 16 in a manner to be described below.

Separating and on the outside of each of the U-shaped channels 30*a* and 30*b* are raised portions of the first surface 26 having flat coplanar surfaces 36 which serve as finger guides during the sharpening process. As illustrated in FIG. 2, the person holding the drill bit 12 may rest his thumb and index finger on the finger guides 36 adjacent to the particular U-shaped channel 30 being utilized to grind the drill bit face 16. This conveniently provides a guide for the user's hand.

The first surface 26 further includes a V-shaped channel 38 which is utilized for sharpening a backside of the cutting edge 18 of the drill bit 12. The V-shaped channel 38 is generally parallel to the first pair of U-shaped channels 30 and extends from and is inclined upwardly with respect to the base plate 22. The V-shaped channel 38 has a diamond-coated steel plate 40 adhered to the outermost interior surface thereof, which provides the grinding surface for the backside of the cutting edge 18. As shown in the drawings, the V-shaped channel 38 is disposed adjacent to an outer edge of the superstructure 24.

The second surface 28 has a construction similar to that described above in connection with the first surface 26. There, a second pair of U-shaped channels 42*a* and 42*b* are provided. These parallel U-shaped channels 42*a* and 42*b* generally extend from and incline upward with respect to the base plate 22. Each has a flat bottom surface 44 to which diamond-coated steel plates 46*a* and 46*b* are adhered. Again, these plates 46*a* and 46*b* are utilized to grind the drill bit face 16 of the drill bit 12 when sharpening the cutting edge 18. Unlike the first pair of U-shaped channels 30, however, the second pair of U-shaped channels 46 have the same width. Finger guides 48 are provided adjacent to each side of the U-shaped channels 42*a* and 42*b*, which are identical to the finger guides 36 provided on the first surface 26.

Moreover, a V-shaped channel 50 is provided on the second surface 28 diametrically opposite the V-shaped channel 38, for sharpening a backside of the cutting edge 18 of the drill bit 12. Like the V-shaped channel 38, the V-shaped channel 50 is generally parallel to the second pair of U-shaped channels 42 and has a diamond-coated steel plate 52 adhered to the outermost interior surface thereof. Moreover, the V-shaped channel 50 is also disposed adjacent to an outer edge of the superstructure 24.

The drill bit sharpener 10 is designed with a sloped angle on each side provided by the first and second surfaces 26 and 28. The four U-shaped channels 30*a*, 30*b*, 42*a* and 42*b* are utilized to grind the drill bit face 16 as illustrated in FIGS. 2 and 3. During the sharpening procedure, the drill bit face 16 is preferably sharpened within the U-shaped channels 30 and 42 from the bottom to the top, and then back to the bottom. Sharpening on a sloped angle creates slightly more pressure on the lower side of the drill bit face 16. The effect is that the least amount of metal is removed from the top of the drill bit face 16, which includes the cutting edge 18 of the bit 12. The greatest amount of metal is removed from the bottom of the drill bit face 16. This ensures that there will be draft on the bit surface, which is required for proper drill bit 12 operation.

The V-shaped channels 38 and 50, and the associated diamond-coated plates 40 and 52, are utilized to dress and sharpen the inside or backside of the drill bit cutting edge 18. The design of the V-shaped channel allows access to this inside or backside of the drill bit cutting edge. Advantageously, the sloped angle of the first and second surfaces 26 and 28, which the V-shaped channels 38 and 50 generally follow, conveniently provide access to the backside of the drill bit cutting edge. As shown in FIG. 4, when accessing the backside of the drill bit cutting edge 18, the body of the drill bit 12 is positioned at an angle that is lower than the respective first or second surface 26 or 28.

From the foregoing it is to be appreciated that a novel drill bit sharpener 10 is provided which is capable of accommodating drill bits 12 of varying diameters and is designed to advantageously help ensure that draft on the bit surface is maintained following the sharpening process. The drill bit sharpener 10 is of simple construction, easy to manufacture and convenient to store and use. The sharpening of drill bits 12 can be accomplished with greater speed and reliability than with the prior hand held file-like sharpeners.

Although a particular embodiment of the invention has been described in detail for purposes of illustration, various modifications may be made without departing from the spirit and scope of the invention. Accordingly, the invention is not to be limited, except as by the appended claims.

I claim:

1. A drill bit sharpener, comprising:

a base plate for supporting the drill bit sharpener over a planar surface;

a superstructure extending upwardly from the base plate and having a first surface generally inclining upwardly from the base plate, said first surface including at least one generally U-shaped first channel means and a generally V-shaped second channel means; and means fixed to the first surface for grinding a face and a backside of the cutting edges of a drill bit, said means including grinding means positioned in said U-shaped first channel means for sharpening the face of the cutting edges of the drill bit and grinding means positioned in said V-shaped second channel means for sharpening the backside of the cutting edges of the drill bit.

2. A drill bit sharpener as set forth in claim 1, wherein the base plate and the superstructure comprise an integral molded unit.

3. A drill bit sharpener as set forth in claim 1, wherein the grinding means includes a diamond-coated steel plate.

4. A drill bit sharpener as set forth in claim 3, wherein the diamond-coated steel plate is adhesively adhered to the first surface of the superstructure.

5. A drill bit sharpener as set forth in claim 1, wherein the second channel means is generally parallel to the first channel means and extends from and is inclined upwardly with respect to the base plate, and wherein the V-shaped channel defines an inner and an outer interior surface and has a diamond-coated plate adhered to the outer interior surface thereof to provide a portion of the grinding means.

6. A drill bit sharpener as set forth in claim 5, wherein the second channel means is disposed adjacent to an outer edge of the superstructure.

7. A drill bit sharpener, comprising:

a base plate for supporting the drill bit sharpener over a planar surface;

a superstructure extending upwardly from the base plate and having a first surface generally inclining upwardly from the base plate, said first surface including a plurality of generally parallel U-shaped channel means extending from and inclined upwardly with respect to the base plate; and means fixed to the first surface for grinding the cutting edge of a drill bit, said means comprising a diamond-coated plate adhered to a bottom surface of each of said U-shaped channel means to provide a grinding means for sharpening a face of the cutting edge of the drill bit.

8. A drill bit sharpener as set forth in claim 7, wherein the first surface includes a planar finger guide on each side of each of the U-shaped channels.

9. A drill bit sharpener as set forth in claim 7, wherein the superstructure includes a second surface generally inclining upwardly from the base plate and diametrically opposite to the first surface, and including means fixed to the second surface for grinding the cutting edge of the drill bit.

10. A drill bit sharpener, comprising:

a rigid planar base plate for supporting the drill bit sharpener over a planar surface;

a superstructure extending upwardly from the base plate and having a first surface generally inclining upwardly from the base plate;

first channel means within the first surface, extending generally from the base plate to an upper end of the superstructure;

first grinding means disposed within the first channel means, for sharpening a face of a drill bit;

second channel means within the first surface, extending generally parallel to the first channel means;

second grinding means disposed within the second channel means for sharpening a backside of a cutting edge of the drill bit; and finger guide means provided on the first surface adjacent to each side of the first channel means.

11. A drill bit sharpener as set forth in claim 10, wherein the base plate and the superstructure comprise an integral molded plastic unit.

12. A drill bit sharpener as set forth in claim 11, wherein the superstructure includes a second surface generally inclining upwardly from the base plate such that the first and second surfaces are disposed diametrically opposite to one another and meet at an upper end of the superstructure.

13. A drill bit sharpener as set forth in claim 10, wherein the first and second grinding means include diamond-coated plates adhesively adhered to the first surface of the superstructure.

14. A drill bit sharpener as set forth in claim 10, wherein the first channel means includes a plurality of parallel U-shaped channels extending from and inclined upwardly with respect to the base plate, and wherein each U-shaped channel has a diamond-coated plate adhered to a bottom surface thereof to provide the first grinding means.

15. A drill bit sharpener as set forth in claim 14, wherein at least two of the parallel U-shaped channels have different widths.

16. A drill bit sharpener as set forth in claim 10, wherein the second channel means is disposed adjacent to an outer edge of the superstructure and comprises a V-shaped channel, and wherein a diamond-coated plate is adhered to an outermost interior surface of the V-shaped channel to provide the second grinding means.

17. A drill bit sharpener as set forth in claim 10, wherein the finger guide means comprises a plurality of raised planar portions of the first surface lying adjacent to each side of the first channel means and separating the first channel means from the second channel means.

18. A drill bit sharpener, comprising:

a rigid planar base plate for supporting the drill bit sharpener over a planar surface;

a superstructure extending upwardly from the base plate and having a first surface generally inclining upwardly from the base plate and a second surface generally inclining upwardly from the base plate, wherein the first and second surfaces are disposed diametrically opposite to one another and meet at an upper end of the superstructure;

a first pair of parallel U-shaped channels within the first surface, extending from the base plate to the upper end of the superstructure, wherein each U-shaped channel has a diamond-coated plate adhered to a bottom surface thereof for sharpening a face of a drill bit, and wherein the first pair of parallel U-shaped channels have different widths;

a second pair of parallel U-shaped channels within the second surface, extending from the base plate to the upper end of the superstructure, wherein each U-shaped channel has a diamond-coated plate adhered to a bottom surface thereof for sharpening the face of the drill bit;

a first V-shaped channel disposed within the first surface adjacent to an outer edge of the superstructure and extending generally parallel to the first pair of U-shaped channels, wherein the first V-shaped channel has a diamond-coated plate adhered to an outermost interior surface thereof to provide means for sharpening the backside of the cutting edge of the drill bit;

a second V-shaped channel disposed within the second surface adjacent to an outer edge of the superstructure and extending generally parallel to the second pair of U-shaped channels, wherein the second V-shaped channel has a diamond-coated plate adhered to an outermost interior surface thereof to provide means for sharpening the backside of the cutting edge of the drill bit; and planar finger guides disposed on each side of the first and second pairs of U-shaped channels.

* * * * *